US010644463B2

(12) United States Patent
Tanizaki et al.

(10) Patent No.: US 10,644,463 B2
(45) Date of Patent: May 5, 2020

(54) CONNECTOR

(71) Applicant: Sumitomo Wiring Systems, Ltd., Yokkaichi, Mie (JP)

(72) Inventors: Toshifumi Tanizaki, Mie (JP); Yu Kito, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/231,634

(22) Filed: Dec. 24, 2018

(65) Prior Publication Data

US 2019/0199040 A1 Jun. 27, 2019

(30) Foreign Application Priority Data

Dec. 26, 2017 (JP) ..... 2017-249533

(51) Int. Cl.

| | |
|---|---|
| ***H01R 13/62*** | (2006.01) |
| ***H01R 13/66*** | (2006.01) |
| ***H01R 13/50*** | (2006.01) |
| ***H01R 13/422*** | (2006.01) |
| ***H01R 13/428*** | (2006.01) |
| ***H01R 13/629*** | (2006.01) |
| ***H01R 13/502*** | (2006.01) |
| *H01R 13/58* | (2006.01) |

(52) U.S. Cl.

CPC ..... *H01R 13/6683* (2013.01); *H01R 13/428* (2013.01); *H01R 13/4223* (2013.01); *H01R 13/501* (2013.01); *H01R 13/502* (2013.01); *H01R 13/629* (2013.01); *H01R 13/5829* (2013.01); *H01R 2201/26* (2013.01)

(58) Field of Classification Search

CPC ..... A61M 5/16886; H01R 13/6683; H01R 13/502; H01R 13/4223; H01R 13/428; H01R 13/629

USPC ..... 439/367

See application file for complete search history.

(56) References Cited

U.S. PATENT DOCUMENTS 3,353,005 A * 11/1967 Burnham ..... B23K 1/008 219/411
4,938,079 A * 7/1990 Goldberg ..... G01F 1/7044 604/65
7,908,931 B1 * 3/2011 Dam ..... G01F 1/7084 73/861.05

(Continued)

FOREIGN PATENT DOCUMENTS

JP 2002-352635 12/2002

*Primary Examiner* — Jean F Duverne

(74) *Attorney, Agent, or Firm* — Gerald E. Hespos; Michael J. Porco; Matthew T. Hespos

(57) ABSTRACT

A connector (10) has terminals (30) connected to wires (W), a housing (20) configured to accommodate the terminals (30), a retainer (40) configured to accommodate the wires (W) while retaining the terminals (30) accommodated in terminal accommodating portions (22) of the housing (20), a temperature sensor (60) to be accommodated in a sensor accommodating portion (56) in the retainer (40) and a holder (80) to be assembled with the retainer (40). The holder (80) has a large divided body (75) and two small divided bodies (70) coupled to the large divided body (75) via hinges (72). The small divided bodies (70) and the large divided body (75) retain the temperature sensor (60) in the sensor accommodating portion (56) while the wires (W) are inserted between the small divided bodies (70) and the large divided body (75).

12 Claims, 13 Drawing Sheets

(56) References Cited

U.S. PATENT DOCUMENTS

| | | | | |
|---|---|---|---|---|
| 9,642,966 | B2 * | 5/2017 | Lee | A61M 5/16886 |
| 2015/0057538 | A1 * | 2/2015 | Cragg | A61M 5/16804<br>600/431 |

* cited by examiner

CONNECTOR

BACKGROUND

Field of the Invention

This specification relates to a connector.

Related Art

Japanese Unexamined Patent Publication No. 2002-352635 discloses a connector with a temperature sensor. This connector includes a metal terminal, a thermistor serving as a temperature sensor and an insulating conductive member arranged in contact with the metal terminal and the thermistor. Heat generated in the metal terminal is transmitted to the thermistor via the insulating conductive member. The temperature sensor and a wire are accommodated in a tube with the temperature sensor extending along the wire to accurately measure a temperature of the wire.

Thought has been given to mounting a holder with a wire insertion hole on the tube. A peripheral edge of the wire insertion hole could function as a retainer that could prevent detachment of the temperature sensor. However, the wire needs to be inserted through the wire insertion hole of the holder in advance, thereby making a holder mounting operation cumbersome.

This specification is intended to simplify the assembly a temperature sensor.

SUMMARY

This specification is directed to a connector with a terminal connected to a wire, a housing configured to accommodate the terminal, and a retainer configured to accommodate the wire pulled out from the housing while retaining the terminal accommodated in the housing. A temperature sensor is arranged along the wire and is accommodated in a sensor accommodating portion in the retainer. A holder is assembled with the retainer. The holder has plural divided bodies with adjacent divided bodies being coupled via a hinge.

The divided bodies are configured to retain the temperature sensor in the sensor accommodating portion while the wire is inserted between the adjacent divided bodies.

According to this configuration, the divided bodies of the holder surround the wire, and the holder is assembled with the retainer to prevent the temperature sensor from coming out from the sensor accommodating portion. In this way, accuracy in measuring a temperature of the wire can be improved and an operation of assembling the temperature sensor can be simplified.

The holder may be assembled by rotating one of the divided bodies about the hinge connection to an adjacent divided body and assembling the adjacent divided bodies to one another. One of these adjacent divided bodies may include a guide configured to guide the adjacent divided bodies to a proper assembled position if one of the divided body deviates from a proper rotation track in the process of rotating the divided bodies. According to this configuration, even if one divided body deviates from the proper rotation track, the divided bodies can be guided to the proper assembled position by the guide and the adjacent divided bodies can be assembled properly. In this way, the temperature sensor can be retained and the temperature of the wire can be measured by the temperature sensor.

At least one of the divided bodies may include a resiliently deformable lock to be locked to the adjacent divided body. The guide may guide the resilient lock into a position to be locked to the adjacent divided body even if one of the divided bodies deviates from the proper rotation track. Accordingly, the adjacent divided bodies can be assembled properly and the temperature sensor can be retained, even if the resilient lock deviates due to improper bending of the hinge or improper deformation of the resilient lock.

At least one of the divided bodies may include wire arranging portions configured to arrange the wires, and the divided bodies may be assembled to face the wire arranging portion via the wire. According to this configuration, the wires are arranged in one of the two adjacent wire arranging portions. Thus, the number of components can be reduced and a holder assembling operation can be simplified as compared to a case where the divided bodies are provided in one-to-one correspondence.

One divided body may include an auxiliary guide near the hinge. The auxiliary guide may be configured to guide one divided body to a proper assembled position by sliding on a surface of the adjacent divided body extending in a direction intersecting a rotating direction of the divided body. Accordingly, a positional deviation of the divided bodies in the intersecting direction can be suppressed by the sliding of the auxiliary guide of one divided body on the sliding surface of the adjacent divided body. Further, the auxiliary guide is near the hinge. Thus, a positional deviation of the divided bodies can be suppressed from an initial stage of rotation as compared to a case where an auxiliary guide is distant from the hinge.

The divided bodies may include positional deviation preventing portions configured to suppress a positional deviation of a mating position of the adjacent divided bodies by contacting each other in a direction intersecting an assembling direction of the adjacent divided bodies. According to this configuration, the positional deviation preventing portions contact each other in the direction intersecting the assembling direction of the adjacent divided bodies. Thus, the positional deviation of the mating position of the divided bodies in the intersecting direction can be suppressed and the temperature sensor can be retained.

Accordingly, the invention simplifies the assembly of a temperature sensor.

DETAILED DESCRIPTION

One embodiment of the invention is described with reference to FIGS. 1 to 13. This embodiment relates to a charging inlet (an example of a connector) 10 provided in a vehicle, such as an electric vehicle, and an unillustrated charging connector is connected when charging a power storage device installed in the vehicle.

Figure 4:
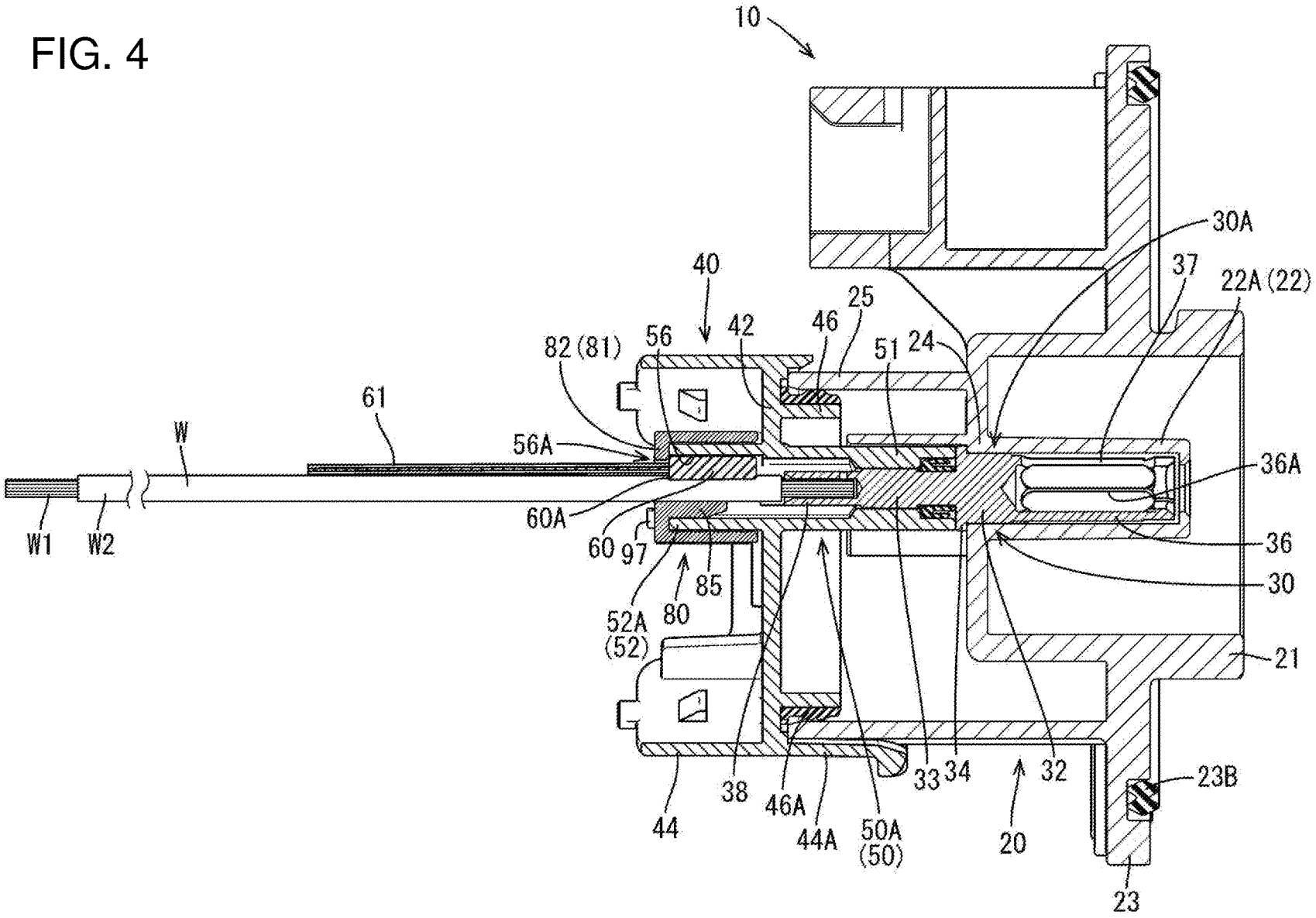
FIG. 4 is a section along A-A in FIG. 3.

As shown in FIG. 4, the charging inlet 10 includes a housing 20, terminals 30 to be accommodated in the housing 20, a retainer 40 for retaining the terminals 30, a temperature sensor 60 for measuring a temperature of a wire W connected to the terminal 30 and a holder 80 for retaining the temperature sensor 60.

Figure 1:
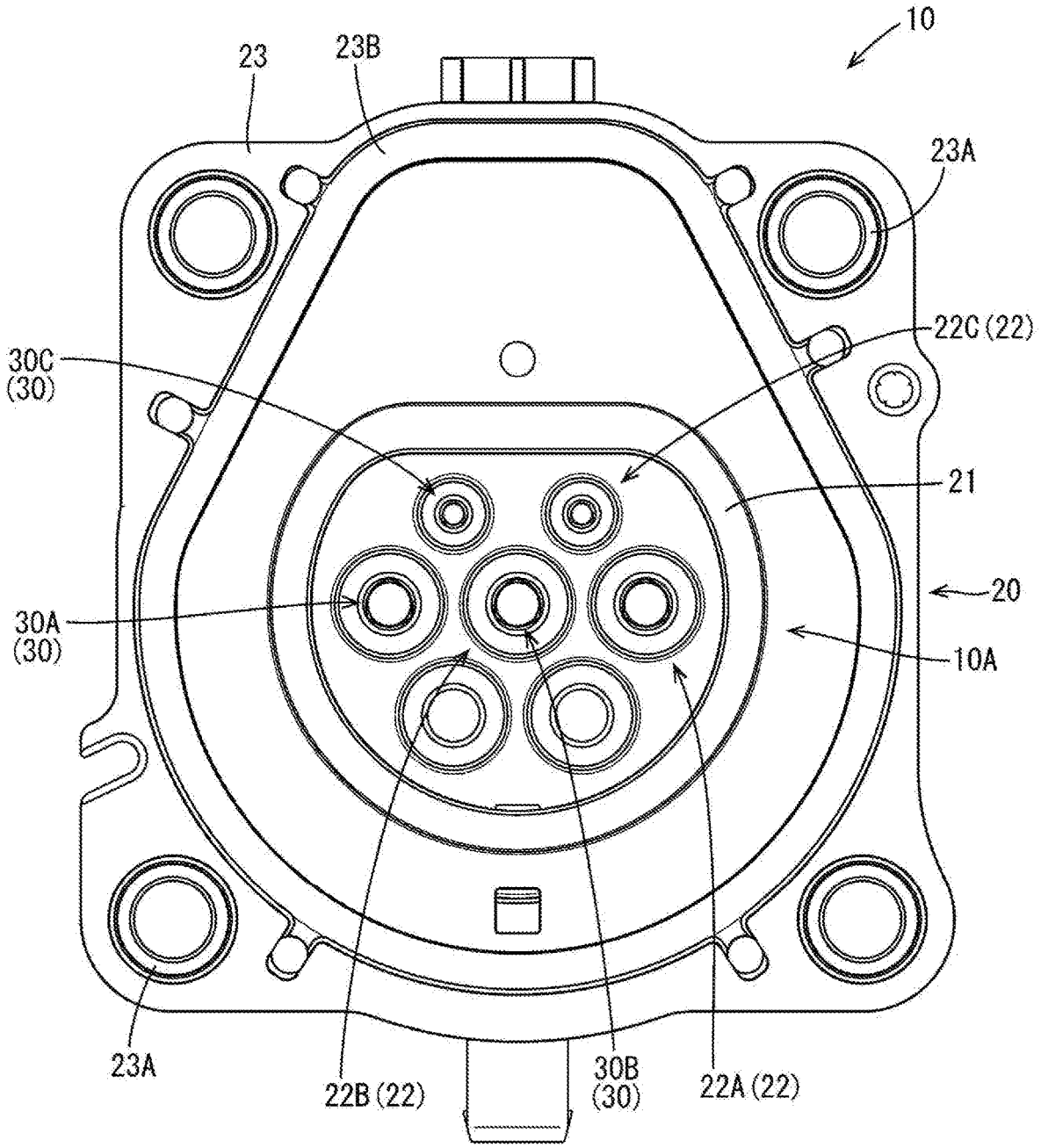
FIG. 1 is a front view of a charging inlet.
Figure 5:
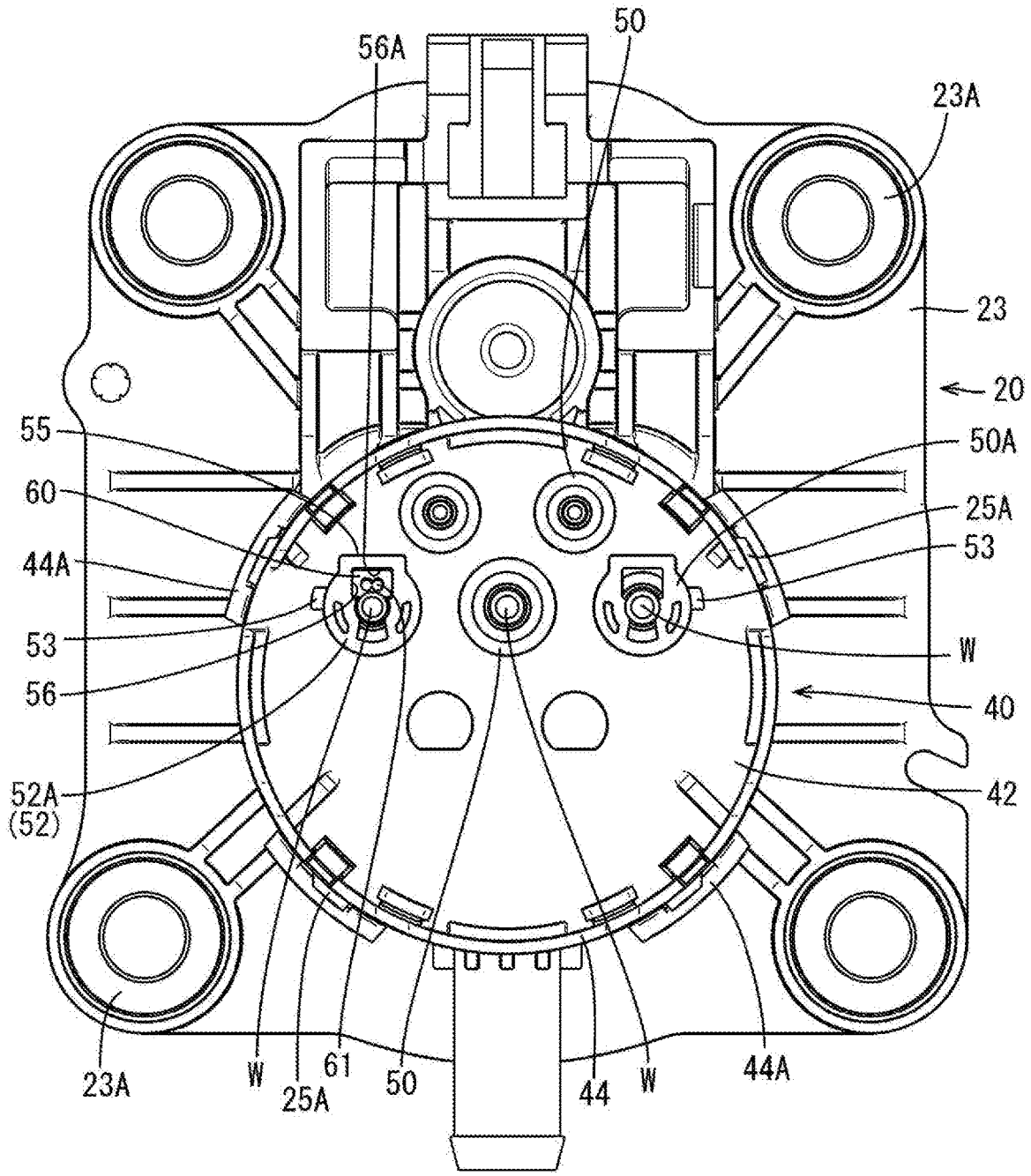
FIG. 5 is a back view of a housing before a holder is assembled with a retainer.

The housing 20 is made of synthetic resin and includes a fitting 21 into which an unillustrated mating connector can be fit. As shown in FIGS. 1, 4 and 5, the fitting 21 is provided with terminal accommodating portions 22 into which the terminals 30 are to be accommodated from behind. A mounting portion 23 in the form of a flat plate is provided around the fitting 21 and is to be mounted on a body of the unillustrated vehicle.

The mounting portion 23 is a substantially rectangular plate with four rounded corners. Collars 23A are provided on the four corners of the mounting portion 23 for receiving unillustrated fastening bolts, and a surface sealing member 23B is mounted to surround the fitting 21 on the front surface of the mounting portion 23.

As shown in FIG. 4, the fitting 21 penetrates through the mounting portion 23 in a front-rear direction, which is a plate thickness direction, and each terminal accommodating portion 22 is a substantially hollow cylinder in the fitting 21.

As shown in FIG. 1, the terminal accommodating portions 22 on both left and right sides serve as power supply terminal accommodating portions 22A for accommodating power supply terminals 30A to be described later, and a ground terminal accommodating portion 22B is disposed between the power supply terminal accommodating portions 22A for accommodating a ground terminal 30B to be described later. Signal terminal accommodating portions 22C are disposed above the power supply terminal accommodating portions 22A and the ground terminal accommodating portion 22B and accommodate signal terminals 30C to be described later. The signal terminal accommodating portions 22C have a smaller diameter than the power supply terminal accommodating portions 22A and the ground terminal accommodating portion 22B.

The terminals 30 to be accommodated into the respective terminal accommodating portions 22 are formed of metal excellent in conductivity. The power supply terminals 30A accommodated in the power supply terminal accommodating portions 22A are for power supply, and the ground terminal 30B be accommodated in the ground terminal accommodating portion 22B is for grounding. Further, the signal terminals 30C accommodated in the signal terminal accommodating portions 22C are for signals, and the signal terminals 30C have a smaller diameter than the power supply terminals 30A and the ground terminal 30B.

FIG. 4 shows the power supply terminal 30A. However, each terminal 30 has a similar configuration. Thus, the power supply terminal 30A is described as a representative and the ground terminal 30B and the signal terminals 30C are not described.

As shown in FIG. 4, the power supply terminal 30A includes a substantially cylindrical large-diameter portion 32, an annular flange 34 protruding from the outer peripheral surface of the large-diameter portion 32, a terminal connecting portion 36 extending forward from the front end of the large-diameter portion 32, a small-diameter portion 33 having a smaller diameter than the large-diameter portion 32 and extending rearward from the flange 34, and a wire connecting portion 38 extending rearward from the rear end of the small-diameter portion 33.

The terminal connecting portion 36 is a substantially cylindrical tube into which an unillustrated mating terminal is to be fit. The terminal connecting portion 36 is provided with resilient pieces 37 by providing slits 36A extending rearward from a front end. The terminal connecting portion 36 has the mating terminal inserted inward of the resilient pieces 37 so that each resilient piece 37 resiliently contacts the mating terminal to achieve electrical connection between the terminal connecting portion 36 and the mating terminal.

The wire connecting portion 38 is a hollow substantially cylindrical closed barrel that is open rearward, and a core W1 of the wire W can be accommodated in the wire connecting portion 38. The wire connecting portion 38 is crimped while the core W1 is accommodated inside, whereby the power supply terminal 30A and the wire W are connected electrically.

A part behind a position of each terminal accommodating portion 22 that penetrates through a back wall of the fitting 21 has a somewhat larger diameter than a front part, as shown in FIG. 4. A part of the power supply terminal accommodating portion 22A where the diameter is switched forms a front stopping flange 24. Sufficient insertion of the power supply terminal 30A into the power supply terminal accommodating portion 22A from behind causes the flange 34 of the power supply terminal 30A to contact the front stopping flange 24 from behind, thereby stopping the power supply terminal 30A in front at a proper terminal mount position.

The terminal connecting portion 36 and the large-diameter portion 32 of the power supply terminal 30A are accommodated in the power supply terminal accommodating portion 22A when the power supply terminal 30A reaches the proper terminal mount position, and the wire connecting portion 38 from which the wire W is pulled out rearward projects rearward from the power supply terminal accommodating portion 22A.

The housing 20 includes a receptacle 25 extending rearward from lower parts of the fitting 21 and the mounting portion 23. The receptacle 25 has a substantially hollow cylindrical shape, and an axis of the receptacle 25 is shifted down with respect to a center axis of the fitting 21. Further, the retainer 40 for retaining each terminal 30 is mountable on a rear part of the receptacle 25.

The retainer 40 includes a retainer body 42 in the form of a circular plate, an outer peripheral wall 44 provided on an outer periphery of the retainer body 42, an inner peripheral wall 46 disposed inside the outer peripheral wall 44 and retaining tubes 50 provided to correspond to the respective terminal accommodating portions 22.

The outer peripheral wall 44 extends in the front-rear direction from the outer peripheral edge of the retainer body 42. Locks 44A are provided on a part of the outer peripheral wall 44 before the retainer body 42 and are resiliently deformable outward. The locks 44A (four in this embodiment) are provided at equal intervals in a circumferential direction, and fix the retainer 40 to the housing 20 by being locked to locking portions 25A (four in this embodiment) provided at equal intervals in the circumferential direction on the outer peripheral surface of the receptacle 25 of the housing 20.

As shown in FIG. 4, the inner peripheral wall 46 extends forward from the retainer body 42 and is inward of the outer peripheral wall 44 on the front surface of the retainer body 42. The inner peripheral wall 46 is a substantially hollow cylinder and an annular rubber ring 46A is fit on the outer periphery of the inner peripheral wall 46. The rubber ring 46A closely contacts the inner peripheral surface of a rear end part of the receptacle 25 to seal between the housing 20 and the retainer 40 when the retainer 40 is fixed to the housing 20.

Each retaining tube 50 is a substantially hollow cylinder. The retaining tube 50 is penetrates through the retainer body 42 in the front-rear direction. A part of the retaining tube 50 before the retainer body 42 defines a front tube portion 51 and a part thereof behind the retainer body 42 defines a rear tube portion 52.

The front tube portion 51 has a part before a substantially central part in the front-rear direction aligned with and fit into the terminal accommodating portion 22 of the housing 20. When the front tube portion 51 is fit into the terminal accommodating portion 22, the small-diameter portion 33 of the terminal 30 is aligned with and fit into a front part in the front tube 51 and the wire connecting portion 38 of the terminal 30 is accommodated into a rear part in the front tube portion 51.

Further, when the retainer 40 is fixed to the housing 20, a front part of the front tube 51 is disposed immediately behind the flange 34 of the terminal 30 accommodated in the terminal accommodating portion 22 and the front tube portion 51 comes into contact with the flange 34 over the entire circumference from behind. Thus, the terminal 30 is retained and held in the terminal accommodating portion 22.

When the retainer 40 is fixed to the housing 20, the rear tube portion 52 has the wire W pulled out rearward from the wire connecting portion 38 accommodated therein and the wire W is pulled out rearward from the rear tube portion 52.

The retaining tubes 50 corresponding to the power supply terminal accommodating portions 22A define power supply terminal tubes 50A. As shown in FIG. 5, an upper part of a rear tube portion 52A of the power supply terminal tube 50A is a flat portion 55 horizontally extending in a lateral direction, and a sensor accommodating portion 56 capable of accommodating the temperature sensor 60 is provided in the rear tube portion 52A of the power supply terminal tube 50A.

A sensor insertion port 56A is provided above the wire W in the rear tube portion 52A of the power supply terminal tube 50A. The sensor insertion port 56A is substantially rectangular in a back view, and the temperature sensor 60 can be accommodated into the sensor accommodating portion 56 through the sensor insertion port 56A.

The temperature sensor 60 is a substantially rectangular block and, as shown in FIG. 4, two signal wires 61 are pulled out rearward from a rear surface 60A of the temperature sensor 60. The temperature sensor 60 is in close contact with an insulation coating W2 of the wire W to extend along an extending direction of the wire W in the rear tube portion 52A. In this way, a temperature of the wire W can be measured accurately.

Further, the holder 80 for retaining the temperature sensor 60 can be mounted on a rear part of the power supply terminal tube 50A.

As shown in FIGS. 3 and 5 to 13, the holder 80 includes a retaining body 81 behind the power supply terminal tubes 50A, and two peripheral walls 90 extending forward along outer peripheral surfaces of the power supply terminal tubes 50A from the retaining body 81.

The retaining body 81 is a flat plate long in the lateral direction over an area of the retainer 40 where the power supply terminal tubes 50A and the retaining tube 50 corresponding to the ground terminal 30B are disposed, and composed of two circular portions 82 on both left and right end parts of the retaining body 81 and a coupling 83 linearly coupling the circular portions 82 in the lateral direction.

A substantially circular wire insertion hole 84 is formed in an axial center of the circular portion 82 and is dimensioned for receiving the wire W. The wires W are pulled out rearward from the wire insertion holes 84 when the holder 80 is mounted on the power supply terminal tubes 50A of the retainer 40.

The circular portion 82 has a substantially circular shape somewhat larger than a rear end opening of the power supply terminal tube 50A, and the peripheral wall 90 is provided on an outer periphery of the circular portion 82.

Figure 12:
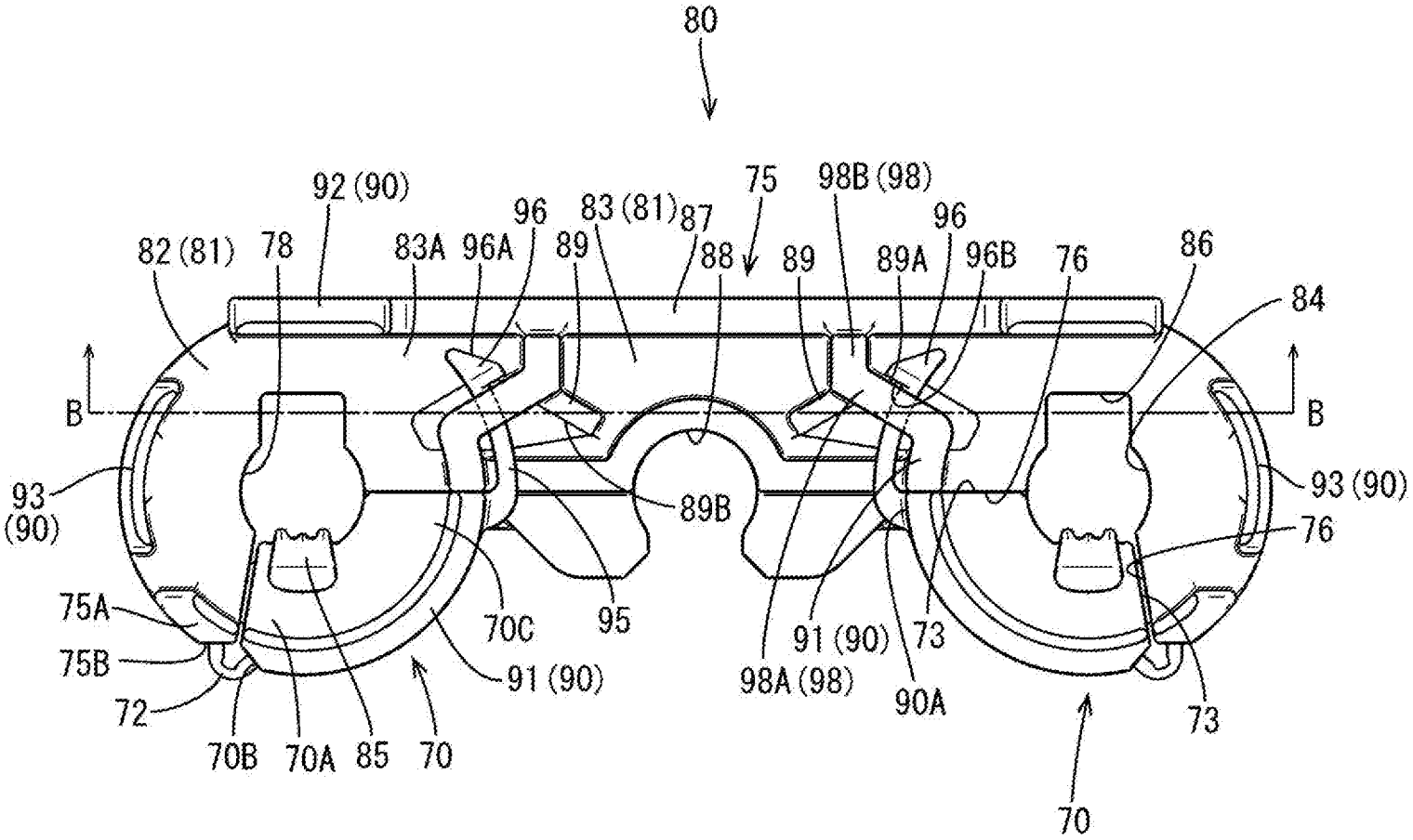
FIG. 12 is a front view showing a state where the small-size divided bodies are assembled with the large-size divided body to configure the holder.
Figure 13:
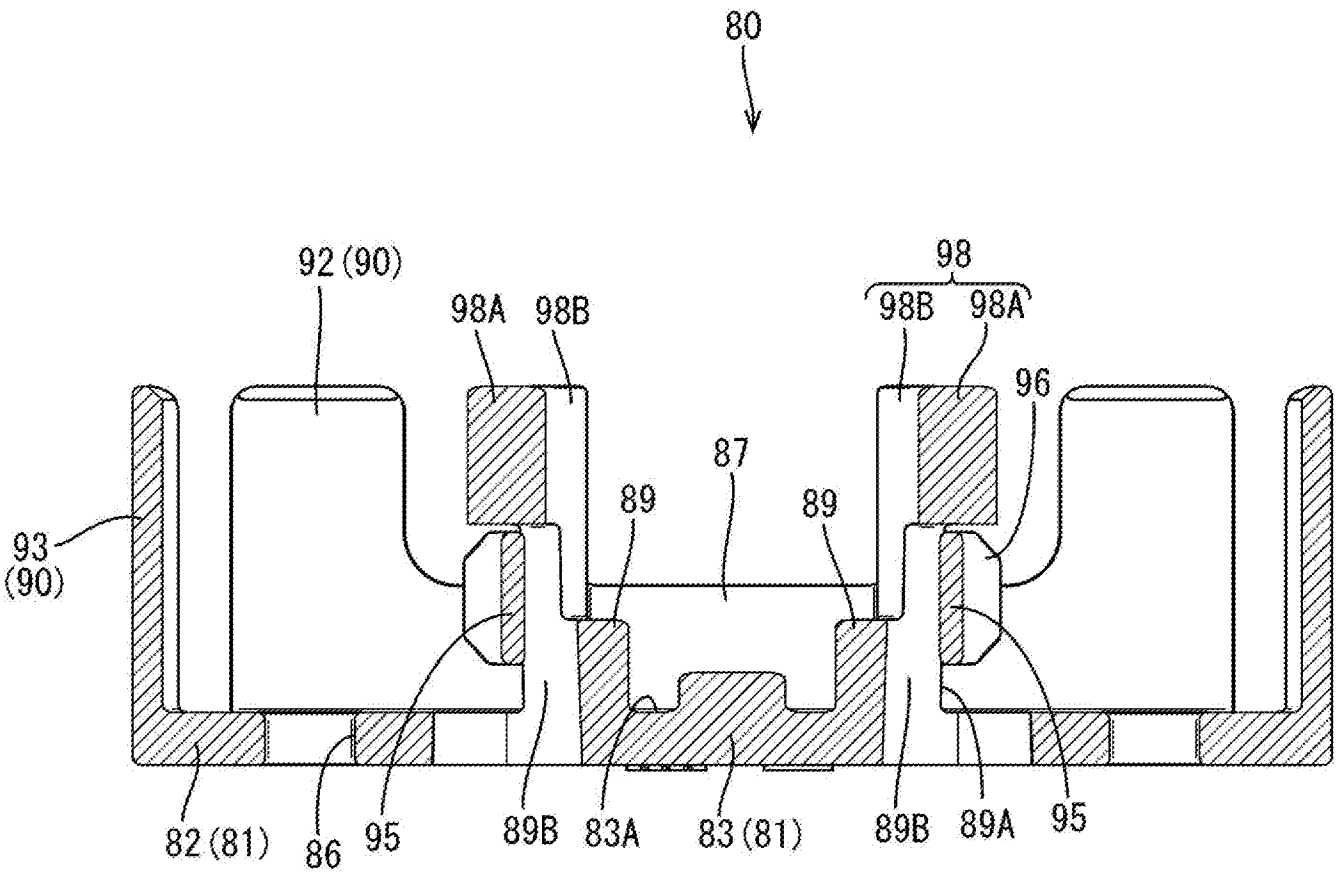
FIG. 13 is a section along B-B in FIG. 12.

As shown in FIG. 12, the peripheral wall 90 has a substantially hollow cylindrical shape by a semicircular wall portion 91 extending from a lower end part of the circular portion 82 to the outer periphery on an inner side, which is the side of the other circular portion 82, a flat plate wall 92 provided on an upper part of the circular portion 82 and a mounting piece 93 on an edge part on an outer side, which is a side opposite to the other circular portion 82. When the holder 80 is mounted on a rear end part of the power supply terminal tube 50A, the rear tube portion 52A of the power supply terminal tube 50A is aligned with and fit into the peripheral wall 90, as shown in FIG. 4.

The flat plate wall 92 extends forward from the upper end edge of the circular portion 82. When the holder 80 is mounted on the retainer 40, the flat plate wall 92 is arranged on the flat portion 55 of the power supply terminal tube 50A so that the retainer 40 can be stable on the holder 80.

Figure 2:
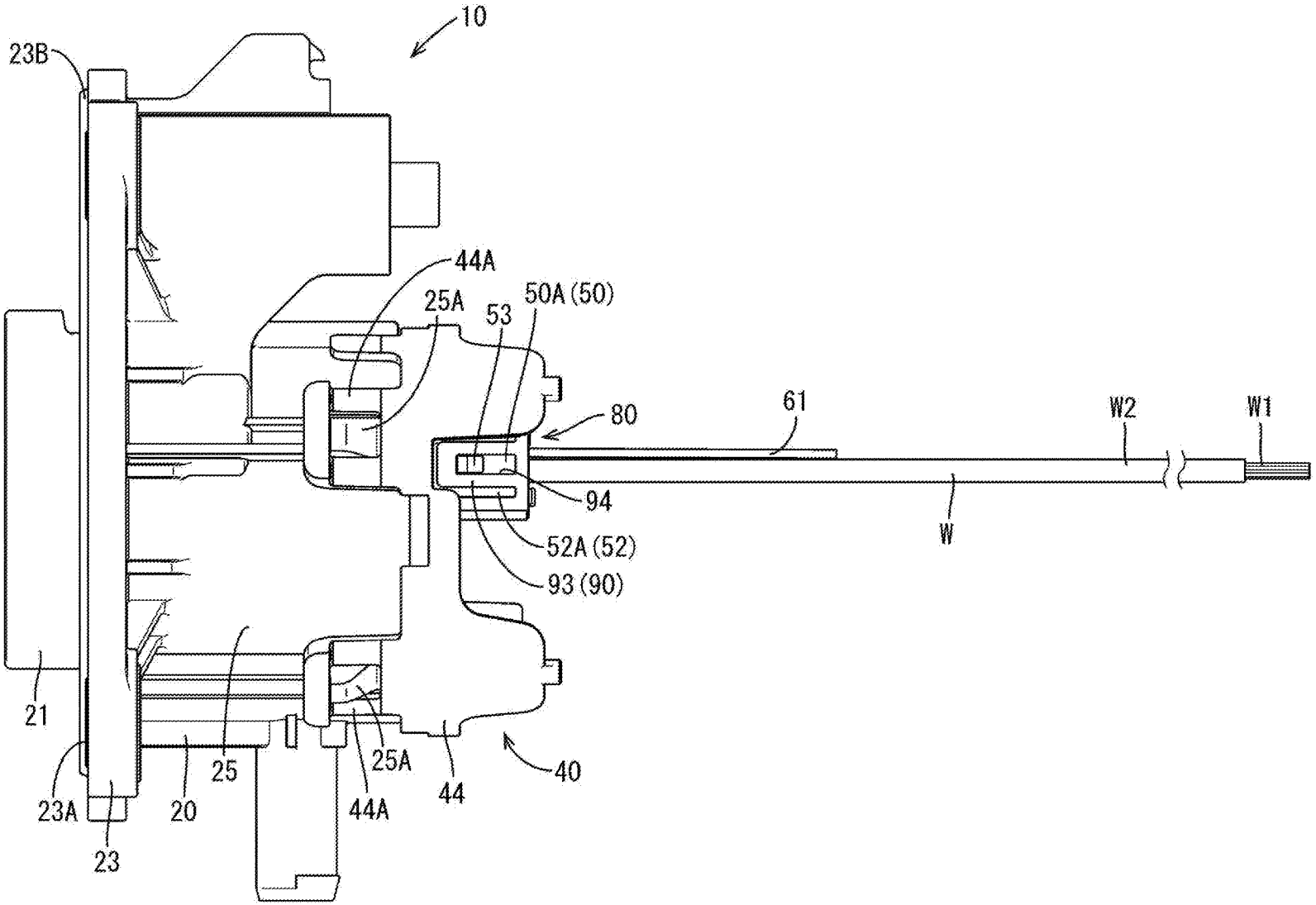
FIG. 2 is a side view of the charging inlet.

The mounting piece 93 is resiliently deformable radially outward. As shown in FIG. 2, the mounting piece 93 has a locking hole 94 extending in the front-rear direction, and a locking projection 53 on the outer surface of the rear tube portion 52A of the power supply terminal tube 50A can fit inside the locking hole 94.

The mounting piece 93 rides on the locking projection 53 in the process of mounting the holder 80 on the retainer 40 and deforms resiliently out. The locking projection 53 is fit in the locking hole 94, and the mounting piece 93 resiliently returns when the holder 80 is mounted at a proper mount position with respect to the retainer 40. The locking projection 53 and the mounting piece 93 are locked in the front-rear direction to fix the holder 80 to the retainer 40.

As shown in FIG. 4, a pressing piece 85 extends forward from the lower side of the wire insertion hole 84 in the circular portion 82. The pressing piece 85 is a substantially rectangular column with a slightly round lower surface in a front view, as shown in FIG. 12, and enters the rear tube portion 52A as shown in FIG. 4 when the holder 80 is mounted on the retainer 40.

The pressing piece 85 that enters the rear tube portion 52A has a function of pressing the wire W against the temperature sensor 60 by being arranged to be somewhat press-fit between the lower surface of the wire W and the inner peripheral surface of the rear tube portion 52A. Thus, the wire W pressed by the pressing piece 85 and the temperature sensor 60 are held in close contact in the rear tube portion 52A. Therefore, accuracy in measuring the temperature of the wire W by the temperature sensor 60 can be improved.

Figure 3:
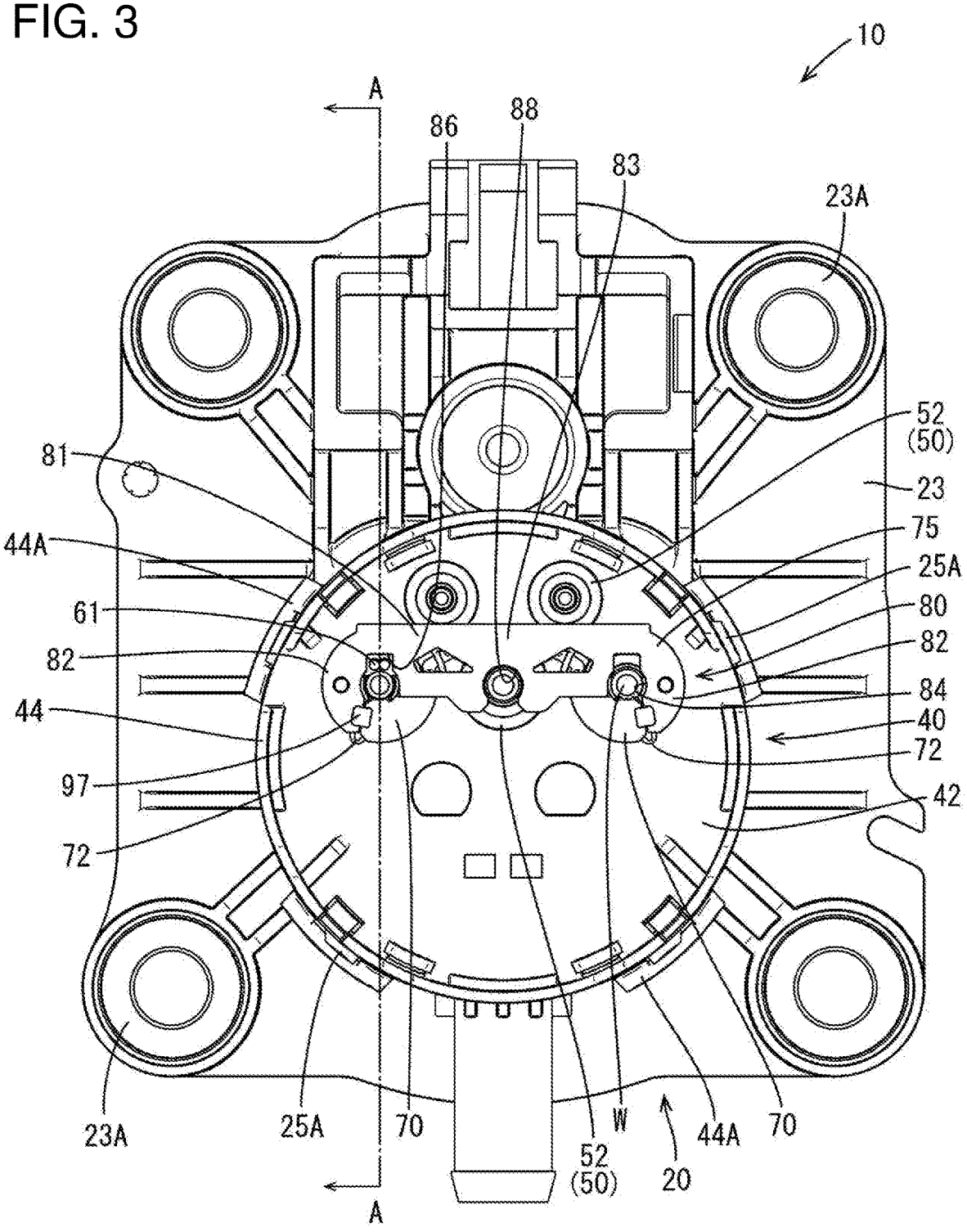
FIG. 3 is a back view of the charging inlet.

As shown in FIG. 3, a signal wire insertion hole 86 is formed above the wire insertion hole 84 in the circular portion 82 and receives the two signal wires 61 pulled out rearward from the temperature sensor 60. The signal wire insertion hole 86 is substantially rectangular and communicates with the wire insertion hole 84.

The signal wire insertion hole 86 is somewhat smaller than the rear surface 60A of the temperature sensor 60. When the holder 80 is mounted on the retainer 40, an outer peripheral part of the signal wire insertion hole 86 can be locked to the rear surface 60A of the temperature sensor 60 in the front-rear direction, as shown in FIG. 4, thereby preventing the temperature sensor 60 from coming out rearward from the sensor accommodating portion 56. Note that the two signal wires 61 are pulled out rearward from the signal wire insertion hole 86 along the upper surface of the wire W.

Figure 7:
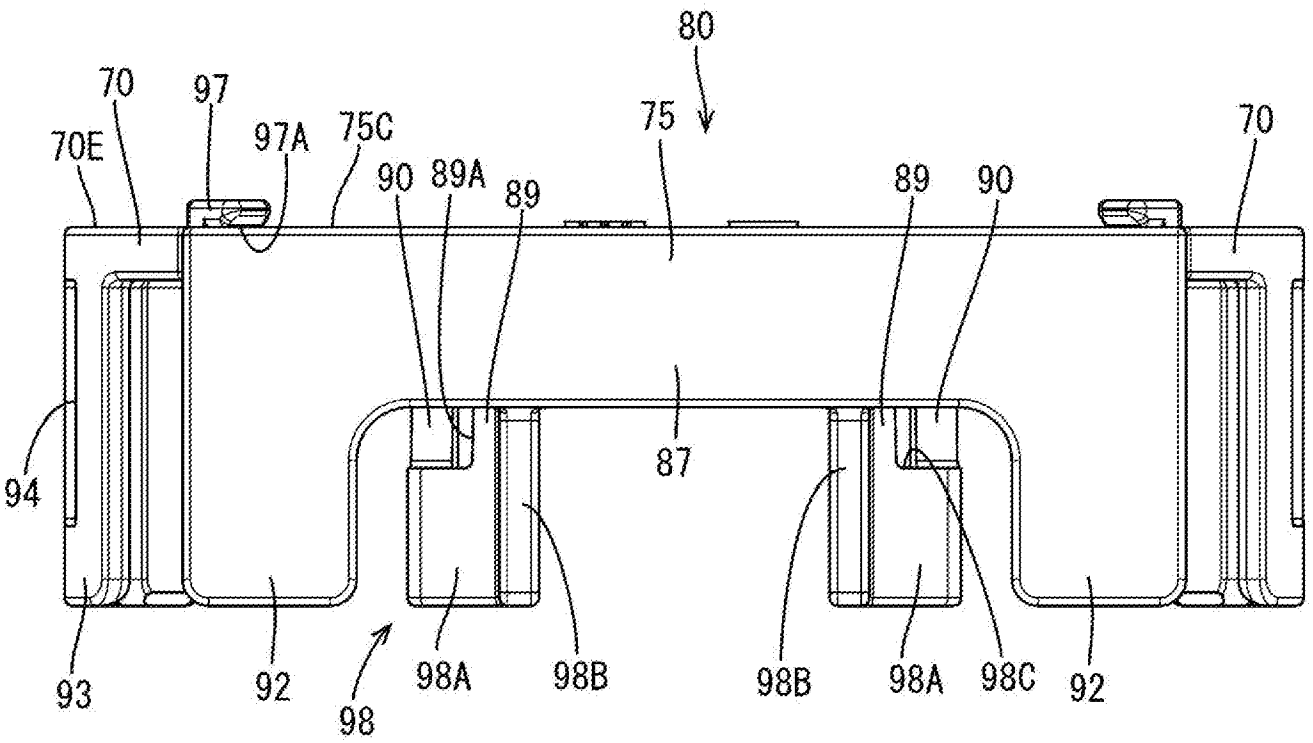
FIG. 7 is a plan view of the holder showing the state before the small-size divided bodies are assembled with the large-size divided body.
Figure 10:
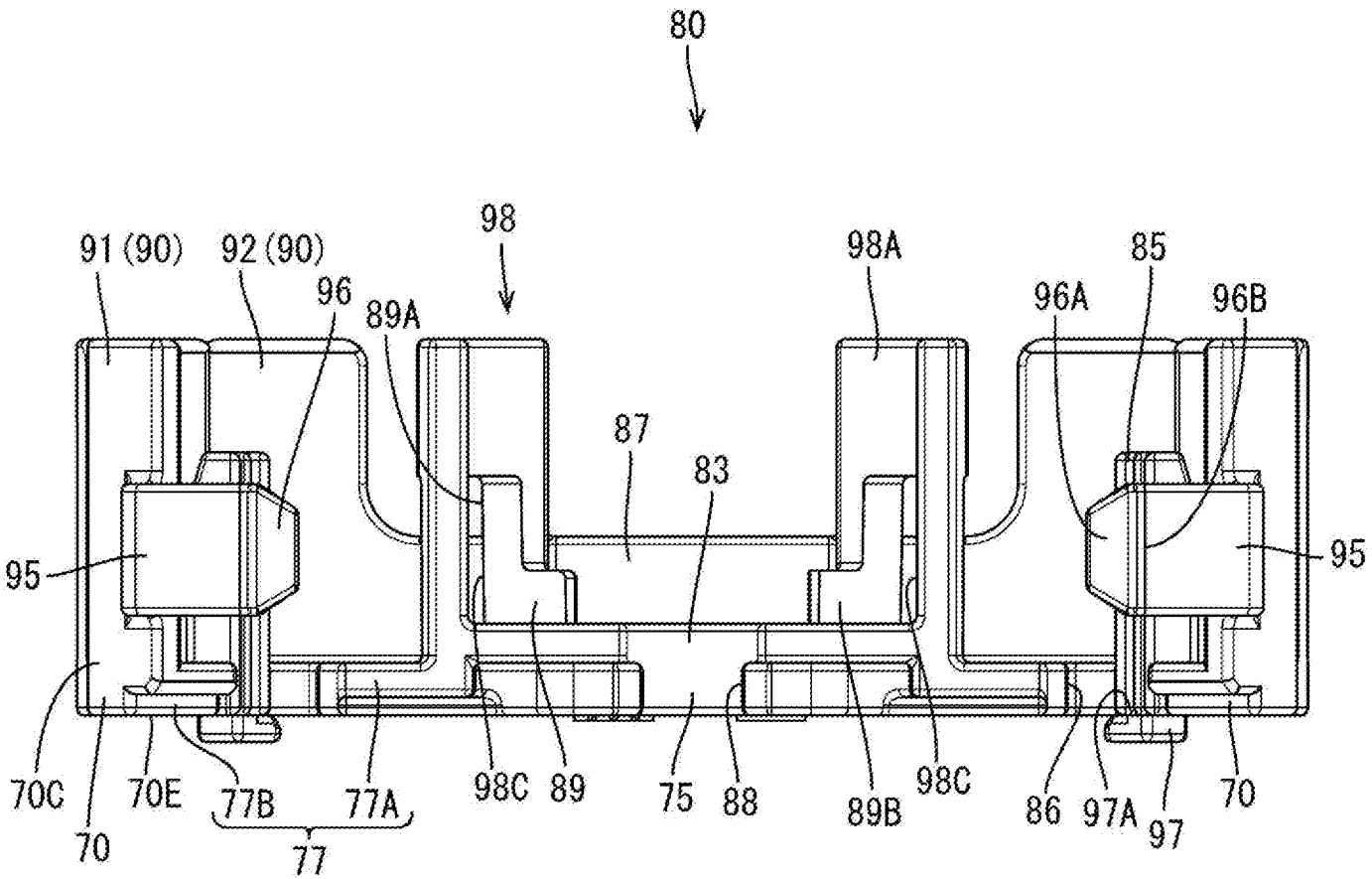
FIG. 10 is a bottom view of the holder showing the state before the small-size divided bodies are assembled with the large-size divided body.

As shown in FIGS. 3 and 12, the coupling 83 laterally couples upper halves on sides adjacent to each other in the two circular portions 82 and has a laterally long shape. An eave 87 is on an upper edge part of the coupling 83 and is a flat plate extending in the lateral direction. The eave 87 couples the flat plate walls 92 in the two circular portions 82, and a length thereof in the front-rear direction is about half the length of the flat plate wall 92 in the front-rear direction, as shown in FIGS. 7 and 10.

As shown in FIGS. 3 and 12, an insertion groove 88 is provided in a substantially laterally central part of the coupling 83 and receives the wire W pulled out rearward from the retaining tube 50 corresponding to the ground terminal accommodating portion 22B.

The insertion groove 88 penetrates in a plate thickness direction and is open downward, so that the wire W can be inserted into the insertion groove 88 through a lower end opening of the insertion groove 88. Further, a distance between inner walls on left and right sides in the lower end opening of the insertion hole 88 is somewhat shorter than an outer diameter of the wire W. Thus, the wire W that is inserted into the insertion groove 88 will not fall down through the lower end opening of the insertion groove 88.

Figure 6:
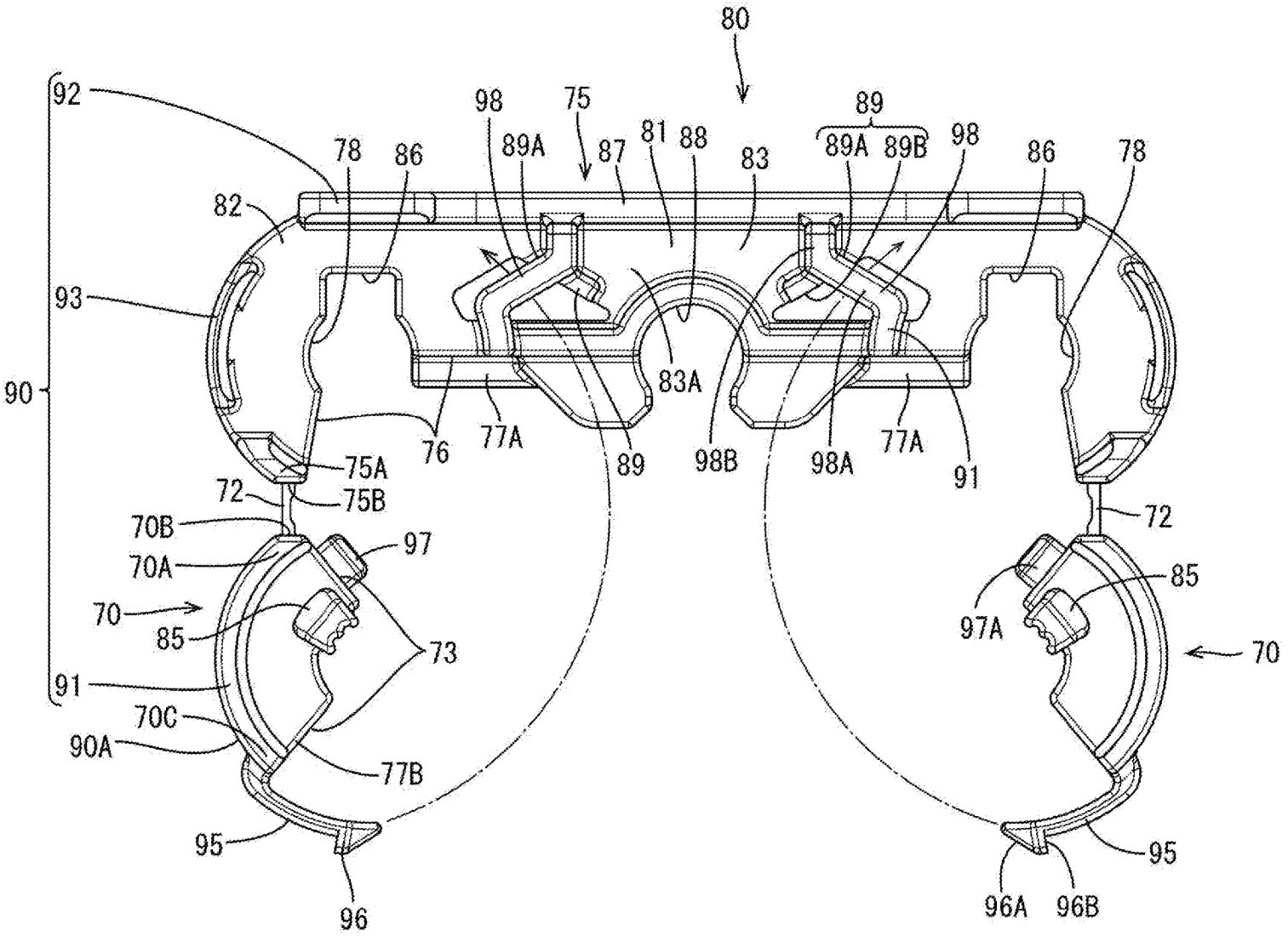
FIG. 6 is a front view of the holder showing a state before small-size divided bodies are assembled with a large-size divided body.
Figure 9:
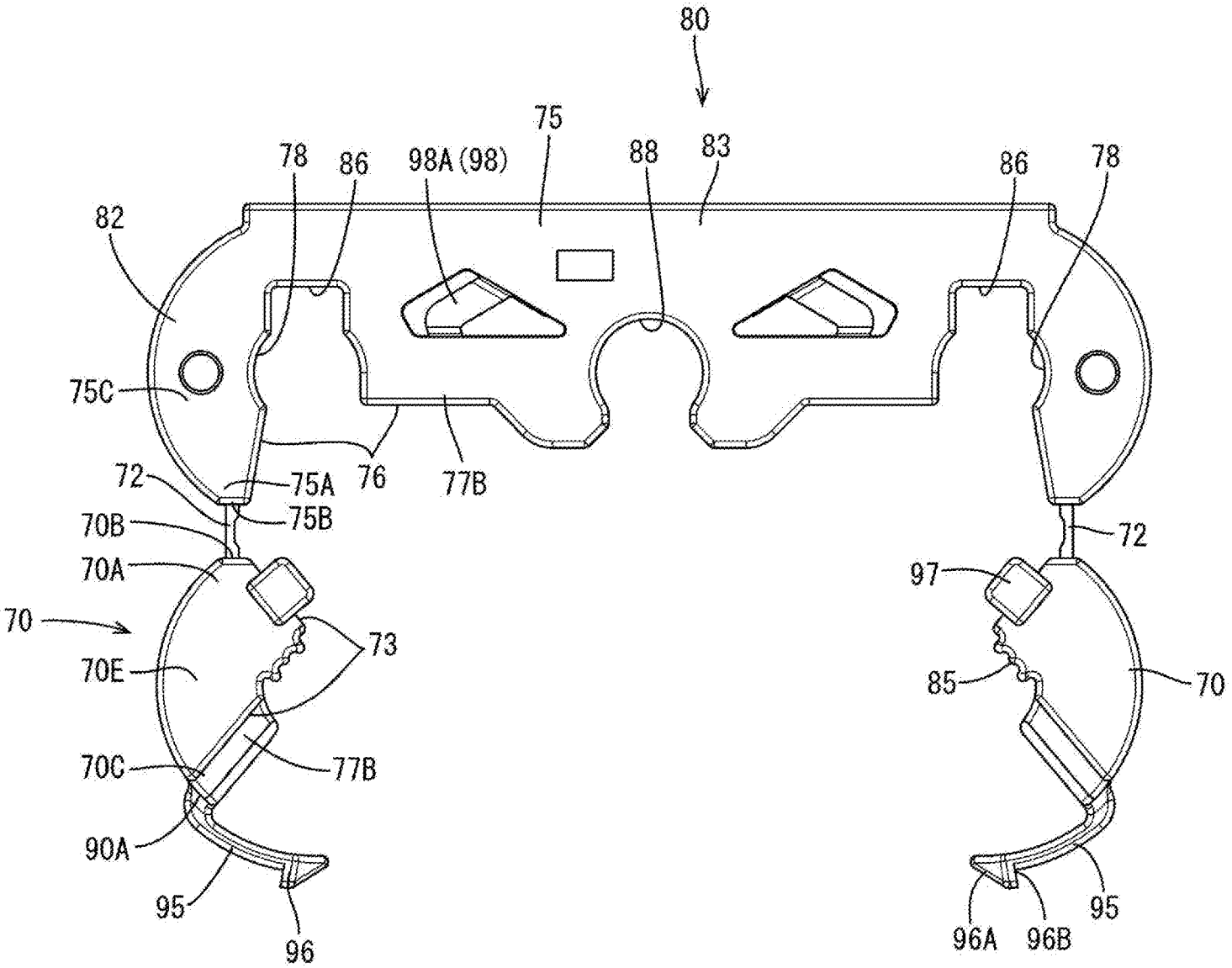
FIG. 9 is a back view of the holder showing the state before the small-size divided bodies are assembled with the large-size divided body.

As shown in FIGS. 6, 9 and 12, the holder 80 is roughly configured by assembling two small divided bodies 70 formed by parts of the circular portions 82 and a large divided body 75 formed by remaining parts of the circular portions 82 and the coupling 83.

In particular, each small divided body 70 is formed by about ¼ part of the circular portion 82 from a part of the circular portion 82 on an inner side (one of sides adjacent to each other in the pair of circular portions 82) of the wire insertion hole 84 to a part below the wire insertion hole 84 and including the pressing piece 85 and the peripheral wall 90 connected to the about ¼ part, and the large divided body 75 is constituted by about ¾ parts of the circular portions 82 excluding the small divided bodies 70 and the peripheral wall portions 90 and the coupling 83 connected to the ¾ parts.

Each small divided body 70 has a substantially arcuate shape and has a first end 70A coupled to the large divided body 75 via a hinge 72. The hinge 72 links an outer peripheral surface 75B of a lower end part 75A in each circular portion 82 of the large divided body 75 and an outer peripheral surface 70B (lower end surface in the circular portion 82) of the first end 70A of the small divided body 70. The adjacent small divided body 70 and large divided body 75 are configured so that the small divided body 70 rotates by bending the hinge 72 with the hinge 72 as a supporting point. When the hinge 72 is bent and the small divided body 70 is displaced along a proper rotation track, two small facing surfaces 73 radially extending in the small divided body 70 and two large facing surfaces 76 radially extending in the large divided body 75 are arranged to constitute each circular portion 82 of the holder 80.

In a state before the small divided bodies 70 are assembled with the large divided body 75, parts of the large divided body 75 that form the wire insertion holes 84 define wire arranging portions 78 in which the wires W are to be arranged. That is, the large divided body 75 includes wire arranging portions 78. The wires W are arranged in the respective wire arranging portions 78 of the large divided body 75 and the small divided bodies 70 are assembled with the large divided body 75 to face the wire arranging portions 78. Thus, the circular portions 82 can be configured with the respective wires W inserted in the wire insertion holes 84.

A resilient locking piece 95 is cantilevered on an outer peripheral surface 90A of the peripheral wall 90 on a second end part 70C opposite to the first end part 70A of the small divided body 70 where the hinge 72 is provided. The resilient locking piece 95 is curved to extend from the peripheral wall 90 of the small divided body 70 along the outer peripheral surface 90A of the peripheral wall 90 in the circular portion 82 of the large divided body 75, and is resiliently deformable radially inward and outward with a base end as a support.

A locking projection 96 projects radially out from a tip part of the resilient locking piece 95. The locking projection 96 has an inclined surface 96A inclined more outward from the tip toward the base of the resilient locking piece 95, and a locking surface 96B extending radially out from the resilient locking piece 95. The locking surface 96B is locked to a locked frame 98 to be described later.

Figure 8:
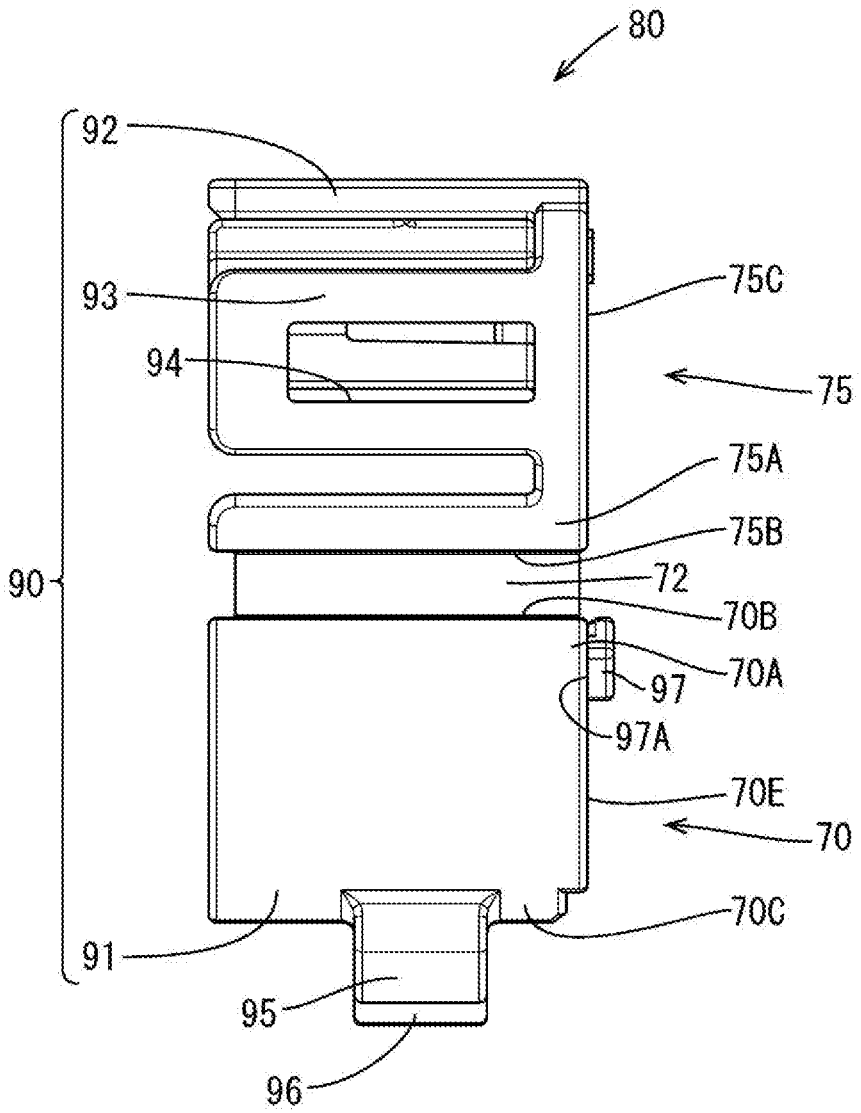
FIG. 8 is a side view of the holder showing the state before the small-size divided bodies are assembled with the large-size divided body.

As shown in FIGS. 1 and 9, an auxiliary guide 97 is provided on the first end 70A of the small divided body 70 where the hinge 72 is provided and projects toward the large divided body 75. This auxiliary guide 97 is a block projecting rearward from a rear surface 70E of the small divided body 70. A positioning surface 97A is provided on the front of a part of the auxiliary guide 97 that projects from the small divided body 70. The positioning surface 97A is flush with the rear surface 70E of the small divided body 70 and a rear surface 75C of the large divided body 75, as shown in FIG. 8.

The positioning surface 97A can slide on the rear surface 75C of the large divided body 75 in an initial stage of assembling the small divided body 70 with the large divided body 75. This sliding is perpendicular to a rotating direction of the small divided body 70 and positions the small divided body 70 at a proper assembled position where the small divided body 70 is not shifted forward with respect to the large divided body 75.

Upper and lower positional deviation preventing portions 77 are provided respectively on the second end part 70C of the small divided body 70 where the hinge 72 is provided and on an edge of the large divided body 75 corresponding to the former edge. The upper and lower positional deviation preventing portions 77 have mating surfaces vertically shifted on front and rear sides. In particular, as shown in FIG. 6, the rear positional deviation preventing portion 77A is on the rear side (back side with respect to the plane of FIG. 6) and is formed at a mating position of the large divided body 75. The front positional deviation preventing portion 77B is on the front side (front side with respect to the plane of FIG. 6) and is at a mating position of the small divided body 70.

Figure 11:
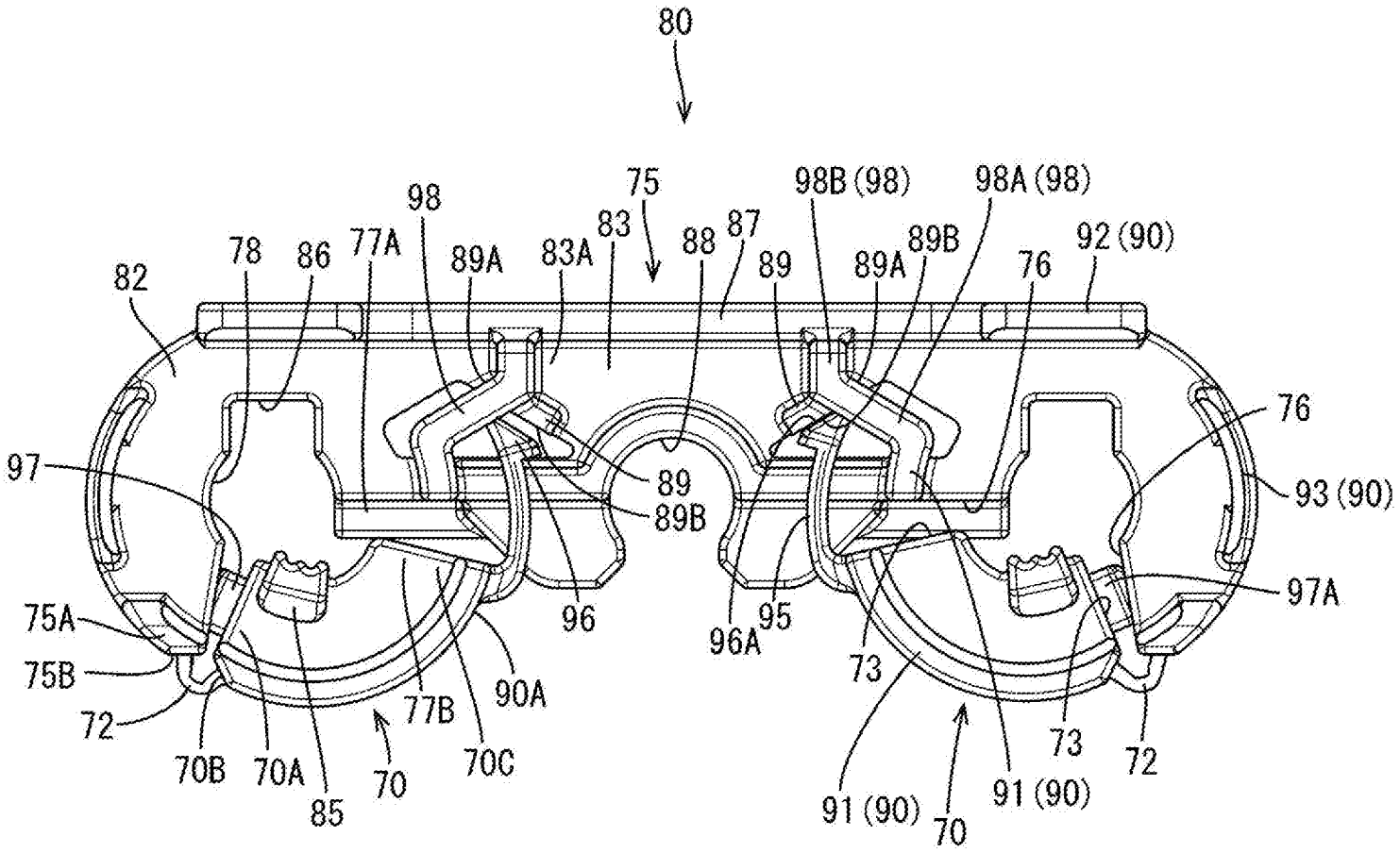
FIG. 11 is a front view showing the process of assembling the small-size divided bodies with the large-size divided body.

The front and rear positional deviation preventing portions 77A, 77B are configured so that the rear positional deviation preventing portion 77A of the large divided body 75 and the front positional deviation preventing portion 77B of the small divided body 70 can be assembled in the front-rear direction intersecting an assembling direction thereof. Additionally, the front and rear positional deviation preventing portions 77A, 77B are positioned so as not to shift from each other in the front-rear direction, as shown in FIG. 11, when the positioning surface 97A of the auxiliary guide 97 and the rear surface 75C of the large divided body 75 start sliding on each other in the process of assembling the small divided body 70 with the large divided body 75.

The locked frame 98 connected to the coupling 83 is provided on an upper part of the peripheral wall 90 on the inner side of each circular portion 82 of the large divided body 75. The locked frame 98 includes an inclined portion 98A extending obliquely in from (a rear part of) the peripheral wall 90 and a vertical portion 98B extending up from the upper end of the inclined portion 98A and coupled to the eave 87.

The vertical portion 98B extends straight down from the eave 87, and a lower end part of the eave 87 is connected to a projecting plate 89 that projects forward from a front surface 83A of the coupling 83. The projecting plate 89 is inclined down from a lower end part of the vertical portion 98B toward an inner side, which is a side opposite to the inclined portion 98A.

The inclined portion 98A is connected to a part of the peripheral wall 90 behind a substantially central part in the front-rear direction and also is connected to an upper part of the projecting plate 89. The inclined portion 98A, the upper part of the peripheral wall 90 and the upper part of the projecting plate 89 form the locked frame 98.

The locking projection 96 of the resilient locking piece 95 is fit into the locked frame 98 in the process of assembling the small divided body 70 with the large divided body 75 by rotating the small divided body 70 along the proper rotation track with the hinge 72 as a supporting. In particular, the locked frame 98 includes a fitting hole 98C into which the locking projection 96 of the resilient locking piece 95 is to be fit. The locking projection 96 of the resilient locking piece 96 enters the fitting hole 98C in the process of assembling the small divided body 70 with the large divided body 75 and contacts the projecting piece 89 of the locked frame 98 to resiliently displace the resilient locking piece 95 radially inward.

The circular portion 82 is configured by the large divided body 75 and the small divided body 70 when the locking projection 96 of the resilient locking piece 95 is fit into the fitting hole 98C of the locked frame 98. Thus, the locking surface 96B of the locking projection 96 and an upper edge 89A of the projecting piece 89 in the locked frame 98 are locked such that the small divided body 70 is fixed in a state assembled with the large divided body 75.

The lower surface of the projecting piece 89 of the locked frame 98 forms a guide surface 89B that inclines toward the locked frame 98 while extending up. The guide surface 89B guides the locking projection 96 of the resilient locking piece 95 into the locked frame 98 if the resilient locking piece 95 is shifted slightly radially out because the hinge 72 is bent in an improper manner or if the resilient locking piece 95 is deformed improperly in the process of assembling the small divided body 70 with the large divided body 75.

An assembling procedure of the charging inlet 10 and functions and effects of the charging inlet 10 are described below.

The charging inlet 10 is assembled by inserting the wires W through the respective retaining tubes 50 of the retainer 40 in advance. The cores W1 of the wires W are inserted into and crimped to the wire connecting portions 38 of the terminals 30. Thereafter, each terminal 30 is inserted into the corresponding terminal accommodating portion 22 of the housing 20 from behind, and the retainer 40 is mounted on the receptacle 25 of the housing 20 from behind. The retaining tubes 50 of the retainer 40 contact the flanges 34 of the terminals 30 from behind to retain the terminals 30, and. Additionally, the locks 44A of the retainer 40 the locks 25A on the outer peripheral surface of the receptacle 25 are locked to hold the retainer 40 on the housing 20.

Subsequently, the holder 80 is mounted on the retainer 40. The holder 80 is configured by assembling the two small divided bodies 70 with the large divided body 75.

In particular, in a state before the small divided bodies 70 are assembled with the large divided body 75, the signal wires 61 pulled out from the temperature sensor 60 are arranged in the signal wire insertion hole 86, and the wires W connected to the power supply terminals 30A are arranged in the respective wire arranging portions 78 of the large divided body 75 of the holder 80. Further, the temperature sensor 60 is arranged in close contact with the insulation coating W2 of the wire W.

After the wires W are arranged in the respective wire arranging portions 78, each small divided body 70 is rotated by bending the hinge 72 with the hinge 72 as a support.

In the process of rotating the small divided body 70 and assembling the small divided body 70 with the large divided body 75, the positioning surface 97A of the auxiliary guide 97 in the small divided body 70 slides on the rear surface 75C of the large divided body 70 and the small divided body 70 is positioned not to be shifted forward with respect to the large divided body 75 in an initial stage.

That is, the auxiliary guide 97 is provided on the first end 70A of the small divided body 70 on the side of the hinge 72. Thus, the small divided body 70 can be positioned at the proper assembled position so as not to be shifted forward with respect to the large divided body 75 by causing the positioning surface 97A to slide on the rear surface 75C of the large divided body 75 from the initial stage, as compared to the case where an auxiliary guide is provided on an end on a side distant from a hinge.

When the positioning surface 97A of the auxiliary guide 97 and the rear surface 75C of the large divided body 75 start sliding on each other, the locking projection 96 on the resilient locking piece 95 of the small divided body 70 starts entering the locked frame 98.

Subsequently, the positioning surface 97A of the auxiliary guide 97 and the rear surface 75C of the large divided body 75 start sliding on each other and the locking projection 96 on the resilient locking piece 95 starts entering the locked frame 98. At that this point, the rear positional deviation preventing portion 77A of the large divided body 75 and the front positional deviation preventing portion 77B of the small divided body 70 are assembled in the front-rear direction and the small divided body 70 and the large divided body 75 are positioned not to be shifted from each other in the front-rear direction.

The small divided body 70 is assembled with the large divided body 75 until the small facing surfaces 73 of the small divided body 70 and the large-side facing surfaces 76 of the large divided body 75 become near each other to configure each circular portion 82 of the holder 80. At this point, the wire W is inserted through the wire insertion hole 84 of the circular portion 82, and the upper edge 89A of the projecting piece 89 in the locked frame 98 and the locking surface 96B of the locking projection 96 are locked to fix the small divided body 70 in the state assembled with the large divided body 75.

The holder 80 with the signal wires 61 and the wires W inserted through the signal wire insertion hole 86 and the wire insertion holes 84 is configured easily without inserting the signal wires 61 of the temperature sensor 60 and the wires W connected to the power supply terminals 30A in the circular portions 82 of the holder 80 in advance.

The hinge 72 could bend improperly so that the small divided body 70 deviates from the proper rotation track to shift the resilient locking piece 95 radially out, as in the right small divided body 70 of FIG. 11. However, the positioning surface 97A of the auxiliary guide 97 and the rear surface 75C of the large divided body 75 slide on each other, and the small divided body 70 is not shifted forward with respect to the large divided body 75 in the process of assembling the small divided body 70 with the large divided body 75. Thus, the guide surface 89B, which is the lower surface of the projecting piece 89, can guide the locking projection 96 of the resilient locking piece 95 to the proper position in the locked frame 98 to lock the upper edge 89A of the projecting piece 89 in the locked frame 98 and the locking surface 96B of the locking projection 96.

In this way, the small divided body 70 can be fixed to the large divided body 75 even if the hinge 72 is bent improperly or the resilient locking piece 95 is deformed improperly, and the holder 80 having the signal wires 61 of the temperature sensor 60 and the wires W connected to the power supply terminals 30A inserted therethrough can be configured.

The rear tube portions 52A of the power supply terminal tubes 50A are fit into the peripheral walls 90 of the holder 80 when the holder 80 having the signal wires 61 and the wires W inserted therethrough is configured. Then, when the holder 80 is assembled at the proper mount position, the locking projections 53 of the rear tube portions 52A of the power supply terminal tubes 50A fit in the locking holes 94 of the mounting pieces 93 of the holder 80 and the locking projections 53 and the mounting pieces 93 are locked in the front-rear direction to fix the holder 80 to the power supply terminal tubes 50A of the retainer 40.

The pressing piece 85 of the holder 80 enters the rear tube portion 52A and is pressed between the lower surface of the wire W and the inner surface of the rear tube portion 52A in the process of fitting the rear tube portion 52A of the power supply terminal tube 50A into the peripheral wall 90 of the holder 80. Thus, the wire W pressed by the pressing piece 85 and the temperature sensor 60 are held in close contact in the rear tube portion 52A to ensure accurate measuring of the temperature of the wire W by the temperature sensor 60.

The outer periphery of the signal wire insertion hole 86 in the circular portion 82 of the retaining body 81 is locked to the rear surface 60A of the temperature sensor 60 in the front-rear direction, when the holder 80 is fixed to the power supply terminal tube 50A of the retainer 40, as shown in FIG. 4. Thus, the temperature sensor 60 cannot come out rearward from the sensor accommodating portion 56.

As described above, the small divided bodies 70 are assembled with the large divided body 75 to configure the holder 80 by arranging the signal wires 61 of the temperature sensor 60 in the signal wire insertion hole 86 and arranging the wires W connected to the power supply terminals 30A in the wire arranging portions 78 before the small divided bodies 70 are assembled with the large divided body 75. Thus, the operation of assembling the temperature sensor 60 and the wires W is simplified, as compared to the case where signal wires and wires are inserted through a signal wire insertion hole and wire insertion holes in advance. Further, the wires are arranged in the two wire arranging portions of the large divided body 75. Thus, the number of components is reduced and the operation of assembling the holder 80 is simplified as compared to the case where divided bodies are provided in one-to-one correspondence.

The resilient locking piece 95 may shift when the small divided body 70 deviates from the proper rotation track due to improper bending of the hinge 72 or improper resilient deformation of the resilient locking piece 95 when assembling the small divided body 70 with the large divided body 75. However, the guide surface 89B of the projecting piece 89 in the large divided body 75 guides the locking projection 96 of the resilient locking piece 95 of the small divided body 70 into the fitting hole 98C of the locked frame 98 with the small divided body 70 in the proper assembled position. Thus, the holder 80 is configured by locking the locking surface 96B of the locking projection 96 and the upper edge 89A of the projecting piece 89 in the locked frame 89. In this way, the temperature sensor 60 can accurately measure the temperature of the wire W.

The small divided body 70 can be positioned at the proper assembled position not to be shifted forward with respect to the large divided body 75 by causing the positioning surface 97A of the auxiliary guide 97 in the small divided body 70 and the rear surface 75C of the large divided body 75 to slide on each other in the initial stage of assembling the small divided body 70 with the large divided body 75.

Further, when the positioning surface 97A of the auxiliary guide 97 and the rear surface 75C of the large divided body 75 start sliding on each other and the locking projection 96 on the resilient locking piece 95 starts entering the locked frame 98, the rear positional deviation preventing portion 77A of the large divided body 75 and the front positional deviation preventing portion 77B of the small divided body 70 are assembled in the front-rear direction and the small divided body 70 and the large divided body 75 are positioned not to shift from each other in the front-rear direction.

Specifically, according to this embodiment, the holder 80 can be configured such that the small divided bodies 70 are positioned in advance not to be shifted radially outward and also in the front-rear direction in assembling the small divided bodies 70 with the large divided body 75.

The invention is not limited to the above described and illustrated embodiment. For example, the following various modes also are included.

In the above embodiment, the holder 80 is configured by assembling the two small divided bodies 70 with the large divided body 75. However, a holder may be configured by assembling two divided bodies or by assembling three divided bodies of the same size.

In the above embodiment, the rear positional deviation preventing portion 77A of the large divided body 75 and the front positional deviation preventing portion 77B of the small divided body 70 are assembled in the front-rear direction when the locking projection 96 on the resilient locking piece 95 starts entering the locked frame 98. However, the rear positional deviation preventing portion 77A of the large divided body 75 and the front positional deviation preventing portion 77B of the small divided body 70 may be assembled in the front-rear direction before the locking projection 96 on the resilient locking piece 95 starts entering the locked frame 98.

In the above embodiment, the retaining body 81 is constituted by the circular portions 82 and the coupling 83 linearly coupling the circular portions 82 in the lateral direction. However, a retaining body may be constituted by two circular portions and a chevron-shaped or arch-shaped coupling that couples the circular portions.

LIST OF REFERENCE SIGNS

10: charging inlet (example of "connector")
20: housing
30: terminal
40: retainer
56: sensor accommodating portion
60: temperature sensor
70: small divided body (example of "one divided body")
72: hinge
75: large divided body (example of "other divided body")
77: positional deviation preventing portion
78: wire arranging portion
80: holder
89B: guide surface (guide)
95: resilient locking piece
97: auxiliary guide
98: locked frame
W: wire

What is claimed is:

1. An electrical connector, comprising:

a terminal having opposite front and rear ends, the front end being configured to connect to a mating terminal, the rear end being connected to a wire;

a housing having opposite front and rear ends and configured to accommodate the terminal, the front end of the housing surrounding the front end of the terminal and the rear end of the housing surrounding the wire;

a retainer mounted to the rear end of the housing and configured to accommodate the wire pulled out from the rear end of the housing while retaining the terminal accommodated in the housing;

a temperature sensor arranged along the wire and accommodated in a sensor accommodating portion provided in the retainer, signal wires extending rearward from the temperature sensor; and a holder assembled with the retainer;

the holder having at least first and second divided bodies that are adjacent to one another and coupled via a hinge; and the second divided bodies body being formed with a signal wire insertion hole configured to retain the signal wires extending rearward from the temperature sensor accommodated in the sensor accommodating portion, the second divided body further being formed with a wire insertion hole communicating with the signal wire insertion hole and configured to retain the wire extending rearward from the terminal, the first divided body being configured to press the wire is inserted between the divided bodies against both the signal wires and the temperature sensor.

2. The electrical connector of claim 1 wherein:

the adjacent divided bodies are assembled by rotating first divided body with the hinge as a support and assembling the first divided body with the second divided body.

3. The electrical connector of claim 2, wherein the second divided body includes a guide configured to guide the first divided body to a proper assembled position when the first divided body deviates from a proper rotation track when rotating the first divided body and assembling the first divided body with the second divided body.

4. The electrical connector of claim 3, wherein:

the first divided body includes a resiliently deformable resilient lock to be locked to a locked frame provided in the second divided body by being inserted into the locked frame; and the guide guides the resilient lock toward and into the locked frame when the first divided body deviates from the proper rotation track.

5. The electrical connector of claim 1, wherein:

the second divided body includes two wire arranging portions configured to arrange the wires; and the divided bodies include two first divided bodies assembled with the second divided body to face the two wire arranging portions around the wire.

6. The electrical connector of claim 2, wherein the first divided body includes an auxiliary guide provided on a side where the hinge is provided, the auxiliary guide being configured to guide the first divided body to a proper assembled position by sliding on a surface of the second divided body extending in a direction intersecting a rotating direction of the first divided body.

7. The electrical connector of claim 2, wherein the divided bodies include positional deviation preventing portions configured to suppress a positional deviation of a mating position of the adjacent divided bodies by contacting each other in a direction intersecting an assembling direction of the adjacent divided bodies.

8. A connector, comprising:

a terminal connected to a wire;

a housing configured to accommodate the terminal;

a retainer configured to accommodate the wire pulled out from the housing while retaining the terminal accommodated in the housing;

a temperature sensor arranged along the wire and accommodated in a sensor accommodating portion provided in the retainer; and a holder assembled with the retainer;

the holder having at least first and second divided bodies that are adjacent to one another and coupled via a hinge; and the divided bodies being configured to retain the temperature sensor accommodated in the sensor accommodating portion while the wire is inserted between the adjacent divided bodies wherein:

the adjacent divided bodies are assembled by rotating first divided body with the hinge as a support and assembling the first divided body with the second divided body; and the second divided body includes a guide configured to guide the first divided body to a proper assembled position when the first divided body deviates from a proper rotation track when rotating the first divided body and assembling the first divided body with the second divided body.

9. The connector of claim 8, wherein:

the first divided body includes a resiliently deformable resilient lock to be locked to a locked frame provided in the second divided body by being inserted into the locked frame; and the guide guides the resilient lock toward and into the locked frame when the first divided body deviates from the proper rotation track.

10. The connector of claim 8, wherein:

the second divided body includes two wire arranging portions configured to arrange the wires; and the divided bodies include two first divided bodies assembled with the second divided body to face the two wire arranging portions around the wire.

11. The connector of claim 8, wherein the first divided body includes an auxiliary guide provided on a side where the hinge is provided, the auxiliary guide being configured to guide the first divided body to the proper assembled position by sliding on a surface of the second divided body extending in a direction intersecting a rotating direction of the first divided body.

12. The connector of claim 8, wherein the divided bodies include positional deviation preventing portions configured to suppress a positional deviation of a mating position of the adjacent divided bodies by contacting each other in a direction intersecting an assembling direction of the adjacent divided bodies.

* * * * *